US010711662B2

(12) United States Patent
Baltrucki et al.

(10) Patent No.: US 10,711,662 B2
(45) Date of Patent: Jul. 14, 2020

(54) SYSTEM COMPRISING A PUMPING ASSEMBLY OPERATIVELY CONNECTED TO A VALVE ACTUATION MOTION SOURCE OR VALVE TRAIN COMPONENT

(71) Applicant: Jacobs Vehicle Systems, Inc., Bloomfield, CT (US)

(72) Inventors: Justin Baltrucki, Canton, CT (US); Scott Nelson, Bolton, CT (US); G. Michael Gron, Jr., Granby, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 14/846,098

(22) Filed: Sep. 4, 2015

(65) Prior Publication Data

US 2016/0069229 A1 Mar. 10, 2016

Related U.S. Application Data

(60) Provisional application No. 62/045,650, filed on Sep. 4, 2014.

(51) Int. Cl.
*F01L 9/02* (2006.01)
*F01L 1/344* (2006.01)
(Continued)

(52) U.S. Cl.
CPC *F01L 9/02* (2013.01); *F01L 1/18* (2013.01); *F01L 1/3442* (2013.01); *F01L 1/46* (2013.01); *F01L 13/06* (2013.01)

(58) Field of Classification Search
CPC . F01L 1/3442; F01L 9/02; F01L 9/021; F01L 9/023; F01L 1/14; F01L 1/146
(Continued)

(56) References Cited

U.S. PATENT DOCUMENTS 2,503,930 A 4/1950 Winkler et al.
3,144,009 A * 8/1964 Goodfellow ..... F01L 1/146 123/90.17
(Continued)

FOREIGN PATENT DOCUMENTS

EP 2317099 A1 5/2011
GB 2030642 A 4/1980
(Continued)

OTHER PUBLICATIONS

International Search Report and Written Opinion filed in PCT/US2015/048614; dated Nov. 25, 2015; 12 pgs.
(Continued)

*Primary Examiner* — Mark A Laurenzi
*Assistant Examiner* — Loren C Edwards
(74) *Attorney, Agent, or Firm* — Moreno IP Law LLC

(57) ABSTRACT

A system for supplying hydraulic fluid in an internal combustion engine comprises a pumping assembly disposed within a housing and a hydraulic circuit, operatively connected to the pumping assembly, also disposed within the housing, which housing may be fixed or dynamic. A source of pumping motions is operatively connected to the pumping assembly, which source of pumping motions may comprise a valve actuation motion source or a component of a valve train between the valve actuation motion source and an engine valve. Pumping motions applied to the pumping assembly by the source of pumping motions causes hydraulic fluid received from a supply pressure hydraulic fluid input of the hydraulic circuit to be transmitted to an increased pressure hydraulic fluid output of the hydraulic circuit.

13 Claims, 18 Drawing Sheets

(51) Int. Cl.
*F01L 1/18* (2006.01)
*F01L 13/06* (2006.01)
*F01L 1/46* (2006.01)

(58) Field of Classification Search
USPC ..... 123/90.12
See application file for complete search history.

(56) References Cited

U.S. PATENT DOCUMENTS

| | | | | |
|---|---|---|---|---|
| 4,602,597 | A * | 7/1986 | Rhoads | F01L 1/146 123/90.15 |
| 5,609,133 | A * | 3/1997 | Håkansson | F01L 1/2411 123/321 |
| 5,806,478 | A * | 9/1998 | Oberg | F01M 9/103 123/90.61 |
| 7,059,282 | B2 | 6/2006 | Vorih et al. | |
| 2005/0132985 | A1 | 6/2005 | Olivetti et al. | |
| 2005/0229888 | A1 | 10/2005 | Vanderpoel | |
| 2006/0185631 | A1 | 8/2006 | Fitzgerald | |
| 2007/0204816 | A1 | 9/2007 | Russell et al. | |
| 2007/0204817 | A1 | 9/2007 | Russell et al. | |
| 2007/0204830 | A1 | 9/2007 | Andri | |
| 2007/0204838 | A1 | 9/2007 | Leone et al. | |
| 2007/0245982 | A1 | 10/2007 | Sturman | |
| 2008/0017171 | A1 | 1/2008 | Stein et al. | |
| 2008/0127933 | A1 | 6/2008 | Blumberg et al. | |
| 2008/0185925 | A1 | 8/2008 | Kurple | |
| 2008/0210195 | A1 | 9/2008 | Saruwatari et al. | |
| 2008/0276913 | A1 | 11/2008 | Zubeck | |
| 2010/0006059 | A1 | 1/2010 | Tradler | |
| 2010/0031901 | A1 | 2/2010 | Dahl et al. | |
| 2010/0282216 | A1 | 11/2010 | Hisaminato et al. | |
| 2011/0048346 | A1 | 3/2011 | Crowe et al. | |
| 2011/0083643 | A1 | 4/2011 | Sturman et al. | |
| 2011/0172891 | A1 | 7/2011 | Stein | |
| 2012/0118251 | A1 * | 5/2012 | Choi | F01L 9/025 123/90.13 |
| 2012/0132174 | A1 | 5/2012 | Boyer et al. | |
| 2013/0180480 | A1 | 7/2013 | Rollinger et al. | |
| 2013/0333640 | A1 | 12/2013 | Kardos et al. | |

FOREIGN PATENT DOCUMENTS

| | | | |
|---|---|---|---|
| JP | S59126011 | A | 7/1984 |
| JP | H0749013 | A | 2/1995 |
| JP | 2006097534 | A | 4/2006 |
| JP | 2008008267 | A | 1/2008 |
| WO | 9925970 | A1 | 5/1999 |
| WO | 2009020504 | A1 | 2/2009 |
| WO | 2009054770 | A1 | 4/2009 |
| WO | 2010126479 | A1 | 11/2010 |

OTHER PUBLICATIONS

International Search Report and Written Opinion filed in PCT/US2015/048614 dated Nov. 25, 2015; 12 pages.

Supplementary European Search Report for European Patent Application No. EP15837829 dated Mar. 20, 2018, 6 pages.

* cited by examiner

SYSTEM COMPRISING A PUMPING ASSEMBLY OPERATIVELY CONNECTED TO A VALVE ACTUATION MOTION SOURCE OR VALVE TRAIN COMPONENT

CROSS-REFERENCE TO RELATED APPLICATION

The instant application claims the benefit of Provisional U.S. Patent Application Ser. No. 62/045,650 entitled "Hydraulic Fluid Supercharging For Engine Brake Supply Or Other Uses" and filed Sep. 4, 2014, the teachings of which are incorporated herein by this reference.

FIELD

The instant disclosure relates generally to the supply of hydraulic fluid in internal combustion engines and, in particular, to a system comprising a pumping assembly operatively connected to a valve actuation motion source or a valve train component.

BACKGROUND

Various systems associated with internal combustion engines rely on a supply of hydraulic fluid, an example of which includes engine oil. For the sake of brevity, the specific example of engine oil is used throughout this disclosure, though it is understood that other fluids are possible.

With efforts to reduce parasitic losses, many engines (including diesel engines) have smaller oil pumps and very low oil pressure available for supplying various systems with oil, including engine brake systems. As known in the art, various engine brake systems or other systems capable of varying the opening and closing times of engine valves (i.e., so-called Variable Valve Actuation (VVA) systems) often rely on one or more hydraulic lost motion components. More specifically, these lost motion components are used to vary the length of a valve train path between a valve actuation motion source and an engine valve. "Lost motion" is a term applied to a class of technical solutions for modifying the valve motion dictated by the otherwise fixed profile of a valve actuation motion source using a variable length mechanical, hydraulic, or other linkage means. A lost motion system may comprise a variable length device included in the valve train linkage between the valve actuation motion source and the engine valve. The fixed valve lift profile of the valve actuation motion source may provide the maximum motion (i.e., longest time between opening and closing as well as the largest lift for any particular valve event) needed for a range of engine operating conditions. When expanded fully, the variable length device within the valve train may transmit all of the valve actuation motion to the valve, and when contracted fully, transmit none or a reduced amount of the valve actuation motion to the valve. By selectively decreasing the length of the lost motion system, part or all of the valve actuation motion can be effectively subtracted or "lost."

Hydraulic-based lost motion systems may provide a variable length device through use of a hydraulically extendable and retractable assembly. For example, in one embodiment, a hydraulic-based lost motion system may utilize a hydraulic circuit, including a master piston and a slave piston, that is selectively charged with hydraulic fluid to actuate an engine valve. When the hydraulic circuit is charged with hydraulic fluid, a hydraulic lock between the master and slave pistons may be created. Given the relatively incompressible nature of the hydraulic fluid, valve actuation motions applied to the master piston are conveyed to the slave piston and, subsequently, the engine valve. On the other hand, the master and slave circuit may be depleted of hydraulic fluid when it is desired to lose the valve actuation motion input to the master piston. Under rapidly changing operating conditions, it often becomes necessary to quickly charge or deplete the hydraulic fluid used to operate such hydraulic-based lost motion systems.

However, as noted above, the availability of only relatively low pressure hydraulic fluid systems often makes the timely charging of hydraulic lost motion systems difficult. It is known to incorporate larger hydraulic supply lines through external components (relative to the engine itself) to provide improved pressure. However some engines have comparatively low pressure even in the main hydraulic fluid supply and such external components cannot increase oil pressure above the main hydraulic fluid supply.

SUMMARY

The above-described shortcomings are addressed through the provision of a system for supplying hydraulic fluid in accordance with the instant disclosure. In an embodiment, such a system comprises a pumping assembly disposed within a housing and a hydraulic circuit, operatively connected to the pumping assembly, also disposed within the housing. In various embodiments, the housing may be fixed or dynamic. A source of pumping motions is operatively connected to the pumping assembly, which source of pumping motions may comprise a valve actuation motion source or a component of a valve train between the valve actuation motion source and an engine valve. Pumping motions applied to the pumping assembly by the source of pumping motions causes hydraulic fluid received from a supply pressure hydraulic fluid input of the hydraulic circuit to be transmitted to an increased pressure hydraulic fluid output of the hydraulic circuit.

In an embodiment, the pumping assembly may comprise a pumping piston slidably disposed within a pumping piston bore formed in the housing and in fluid communication with the hydraulic circuit. A resilient element may be used to bias the pumping piston either out of or into the pumping piston bore. In another embodiment, the pumping assembly may comprise a contact-based pressure regulator operatively connected to the pumping piston. The contact-based pressure regulator may comprise a spring-loaded piston disposed within the pumping piston or a resilient element biasing the pumping piston into the pumping piston bore. In this embodiment, an accumulator may be provided in fluid communication with the hydraulic circuit between the pumping piston bore and the increased pressure hydraulic fluid output. Alternatively, in various embodiments, the system may comprise one or more accumulators in fluid communication with, and upstream of, the increased pressure hydraulic fluid output.

In another embodiment, the source of pumping motions contacts the housing. In this embodiment, the system further comprises a fixed contact surface (i.e., fixed, in this context, once again meaning substantially immobile relative to valve actuation motions provided by the valve actuation motion source) configured such that pumping motions applied by the source of pumping motions causes the pumping assembly to contact the fixed contact surface. In various embodiments, the valve actuation motion source (which may constitute the source of pumping motions) may comprise a cam on a camshaft. Alternatively, the component of the valve train serving as the source of pumping motions may comprise a rocker arm, valve bridge, push rod or cam follower.

Optionally, a check valve may be disposed within the hydraulic circuit between the supply pressure hydraulic fluid input and the pumping assembly. In this case, the check valve may be configured to prevent flow from the hydraulic circuit toward the supply pressure hydraulic fluid input.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
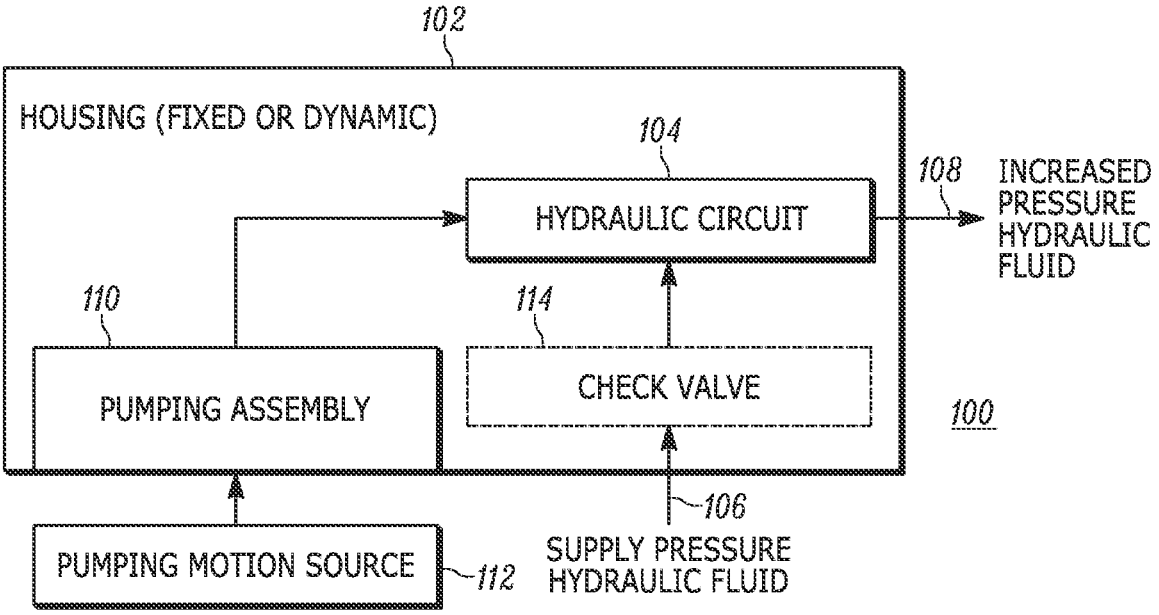
FIGS. 1 and 2 are schematic block diagrams illustrating systems in accordance with the instant disclosure.

Referring now to FIG. 1, a block diagram of a system 100 in accordance with the instant disclosure is illustrated. In particular, the system comprises a housing 102 having a hydraulic circuit 104 disposed therein. The hydraulic circuit 104 comprises a supply pressure hydraulic fluid input 106 and an increased pressure hydraulic fluid output 108 as shown. Further, a pumping assembly 110 is also disposed within the housing 102 and operatively connected to (i.e., in fluid communication with) the hydraulic circuit 104 between the supply pressure hydraulic fluid input 106 and the increased pressure hydraulic fluid output 108. A source of pumping motions 112 is operatively connected to the pumping assembly 106. Finally, an optional check valve 114 may be provided between the supply pressure hydraulic fluid input 106 at a point where the pumping assembly is operatively connected to the hydraulic circuit 104.

The housing 102 in FIG. 1 may comprise a fixed or dynamic housing. As used herein, a component is "fixed" to the extent that it is essentially (i.e., within design parameters and tolerances) immobile relative to valve actuation motions provided by a valve actuation motion source. In contrast, as used herein, a component is "dynamic" to the extent that it is capable of movement driven at least in part by valve actuation motions provided by a valve actuation motion source. As described in various embodiments described below, the housing 102, when fixed, may be embodied in an engine valve overhead fixture or an engine support structure, or, when dynamic, may be embodied in any of a number of valve train components including a rocker arm, valve bridge, pushrod or cam follower.

Generally, supply pressure hydraulic fluid is provided to the input 106 thereby continuously charging the hydraulic circuit 104 to the extent possible given the pressurization of the supply hydraulic fluid. Typically, the pressure of supply pressure hydraulic fluid is in the range of about 1-2 Barg (14.5 to 29 PSIG) in low pressure systems. In some instances, operation of the pumping assembly 110 may assist in charging of the hydraulic circuit 104 by helping to draw hydraulic fluid into the hydraulic circuit 104. As pumping motions are applied to the pumping assembly 110 by the pumping motion source 112, hydraulic fluid within the hydraulic circuit 104 may be subjected to an increased force applied by the pumping assembly 110. Consequently, the hydraulic fluid within the hydraulic circuit is increasingly pressurized (assuming a substantially uniform cross-sectional area of the hydraulic circuit 104) as it is transported to the increased pressure hydraulic fluid output 108. When provided, the optional check valve 114 is configured to permit one-way passage of hydraulic fluid into the hydraulic circuit 104 but not back toward the source of the supply pressure hydraulic fluid, thereby isolating the increased pressure hydraulic fluid output from the supply pressure hydraulic fluid input. Although various embodiments described herein illustrate such use of the optional check valve 114, those skilled in the art will appreciate that it may not be necessary in all instances. For example, the relative cross-sectional area of at least a portion of the supply pressure hydraulic fluid input 106 may be comparatively smaller (e.g., an in-line restriction or orifice) than a cross-sectional area of the increased pressure hydraulic fluid output 108. Consequently, while increased pressurization of the charge within the hydraulic circuit 104 may cause some hydraulic fluid to flow back toward the supply, such flow may be comparatively minimal relative to the flow toward the output.

Furthermore, in all embodiments described herein, the increased pressure hydraulic fluid output 108, while available for various uses, does not directly cause any engine valve actuations. That is, unlike a master/slave piston hydraulic circuits in lost motion systems in which hydraulically locked fluid conveys valve actuation motions from the master piston to the slave piston, the pumping motions applied by the source 112 do not result in any valve actuation motions.

The source of pumping motions 112 provides typically cyclical, reciprocating pumping motions derived from valve actuation motions. Consequently, the source of pumping motions 112 may comprise either a valve actuation motion source or a component of a valve train. By way of non-limiting example, and as illustrated in various embodiments described below, a valve actuation motion source may comprise a cam on a rotating camshaft, whereas a component of a valve train may comprise a cam follower, pushrod, rocker arm or valve bridge. Still other valve train components as known in the art may serve as the source of pumping motions 112.

Figure 2:
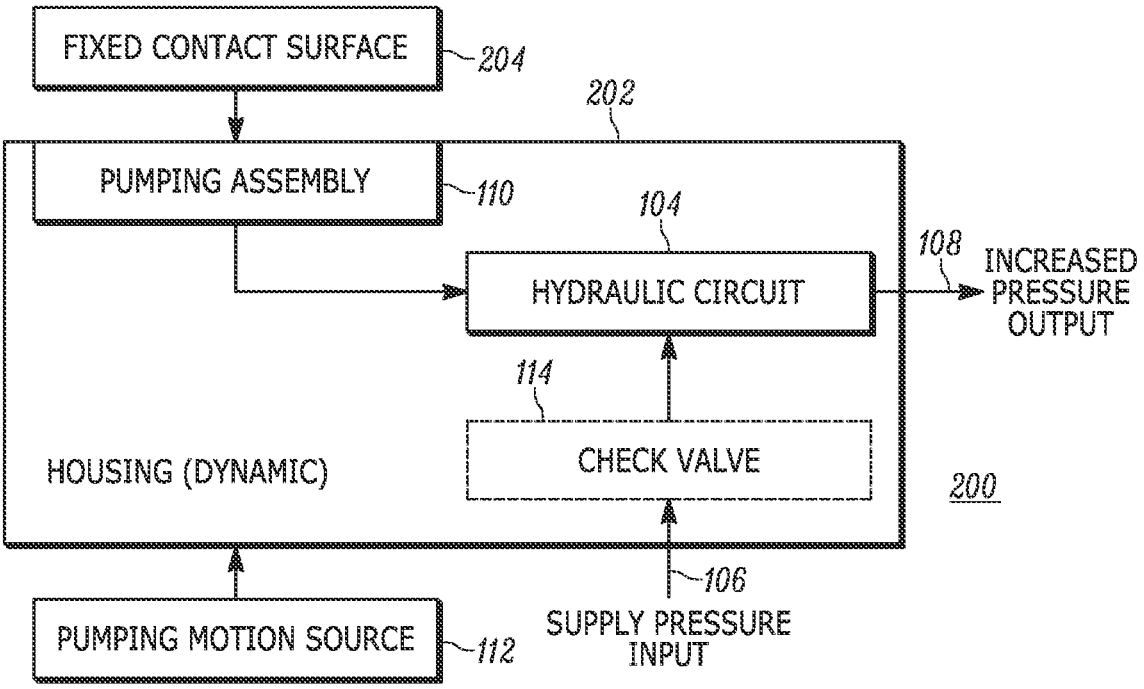

Referring now to FIG. 2, an alternate embodiment of a system in accordance with the instant disclosure is illustrated. As in the case of FIG. 1, the system 200 of FIG. 2 comprises a housing 202 having a hydraulic circuit 104 and pumping assembly 110 disposed therein and operatively connected to each other. Likewise, the hydraulic circuit 104 comprises a supply pressure hydraulic fluid input 106, an increased pressure hydraulic fluid output 108 and an optional check valve 114 as shown. In contrast to FIG. 1, however, the housing 202 is only dynamic and, relatedly, the source of pumping motion 112 is operatively connected to the housing 202 rather than the pumping assembly 110. Further still, a fixed contact surface 204 is also provided and configured to operatively connect with the pumping assembly 110.

In the embodiment of FIG. 2, as the source of pumping motions 112 provides the pumping motions to the housing 202, reciprocal pumping motions cause the housing 202 to likewise engage in reciprocal motion. In turn, the reciprocal motion of the housing 202 causes the pumping assembly 110 to contact the fixed contact surface 204, thereby inducing pumping action. In this embodiment, it may be considered that the fixed contact surface 204 constitutes a portion of the pumping assembly 110 to the extent that the fixed contact surface 204 assists in inducing pumping action. FIGS. 3-28, described below, illustrate various specific embodiments in accordance with the more general embodiments illustrated in FIGS. 1 and 2.

Figure 3:
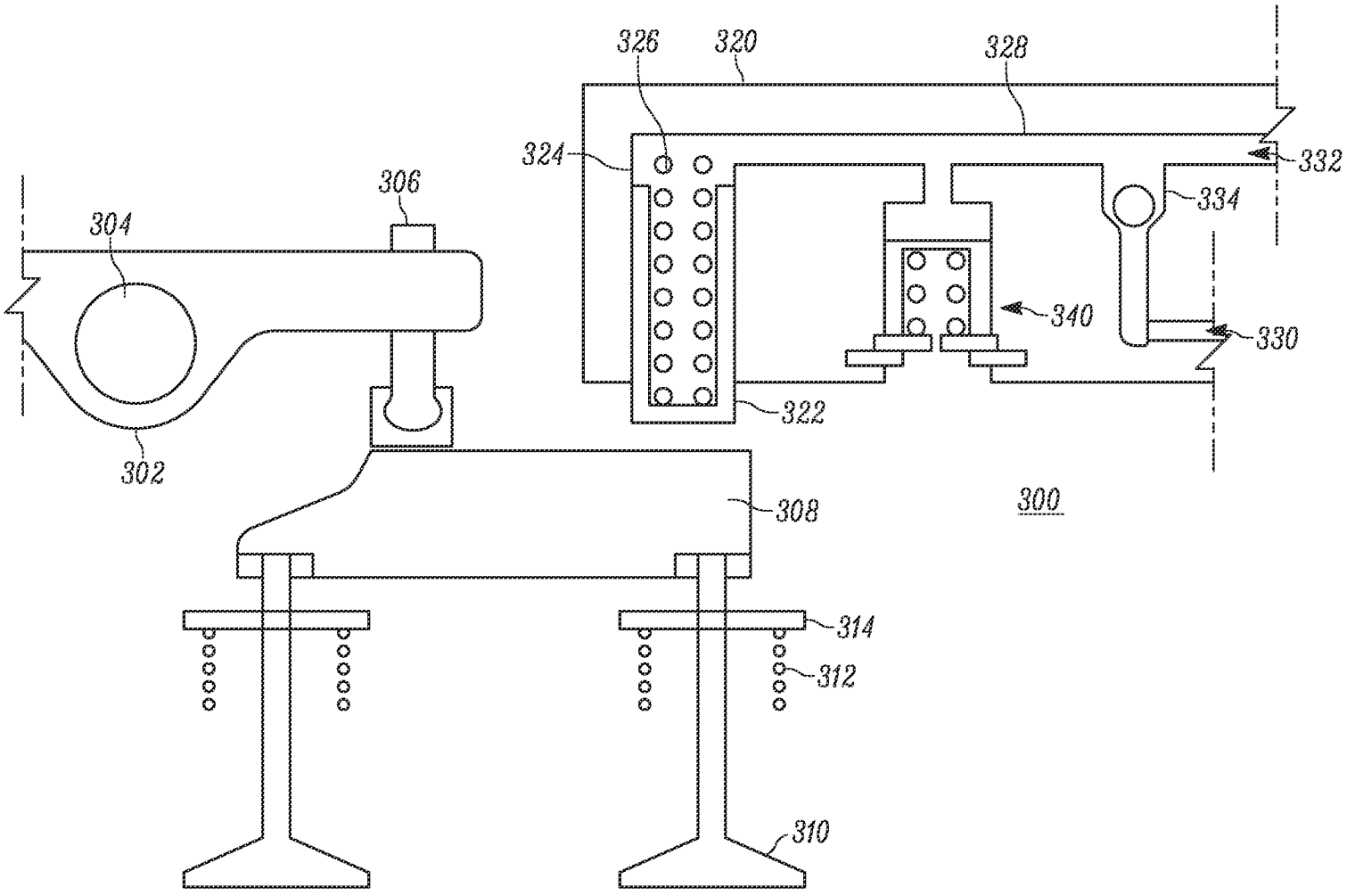
FIGS. 3 and 4 illustrate embodiments in accordance with the instant disclosure comprising a pumping assembly disposed within a fixed overhead in which pumping motions are provided during valve closing.

Referring now to FIG. 3, a system 300 comprises a rocker arm 302 mounted on a rocker shaft 304. An adjusting screw assembly 306 makes contact with a valve bridge 308 used to open engine valves 310, which are returned to a closed position by valve springs 312 contacting spring retainers 314. As known in the art, the rocker arm 302 may be reciprocated by a valve actuation motion source (not shown) such as, by way of non-limiting examples, a cam follower or roller contacting a rotating cam, or a pushrod actuator in an engine block driven by a rotating cam.

During closure of the valves 310, lost motion brake hardware, for example, may require improved hydraulic fluid supply pressure to refill the lost motion hydraulic circuits. Thus, in the example of FIG. 3, a fixed overhead housing 320 is positioned, at least in part, above the valve bridge 308, as shown. The overhead housing 320 comprises a pumping piston 322 disposed within a pumping piston bore 324. Though not shown, one or more hydraulic passage may be provided in fluid communication with the pumping piston bore 324 to provide lubrication to the pumping piston 322. As further shown, a resilient element 326, such as spring, may be provided to bias the pumping piston 322 out of the pumping piston bore 324. Alternatively, a resilient element may be provided to bias the pumping piston 322 into the pumping bore 324. The pumping piston bore 324 is in fluid communication with a hydraulic circuit 328 that, in turn, comprises a supply pressure hydraulic fluid input 330 and an increased pressure hydraulic fluid output 332. As further shown, the hydraulic circuit 328 may also include a check valve 334 as described above relative to FIGS. 1 and 2. In this embodiment, the pumping piston 322 and the pumping piston bore 324 constitute a pumping assembly as described above.

So long as hydraulic fluid is provided to the hydraulic circuit 328 by the supply pressure hydraulic input 330, hydraulic fluid will charge the hydraulic circuit 328. Absent action by the pumping piston 322, the charge within the hydraulic circuit 328 will remain at substantially the same pressure as the supply pressure hydraulic input 330. Furthermore, biasing of the pumping piston 322 out of the pumping piston bore 324 by the resilient element 326 may serve to help draw hydraulic fluid into the hydraulic circuit 328.

During closure of the engine valves 310, the valve springs 312 cause the valve bridge 308 to translate upward and thereby contact the pumping piston 322. The pumping piston 322 is, in turn, pushed upwards by the force of the valve springs 312 acting through the valve bridge 308. This pumping action by the pumping piston 322 causes the charge within the hydraulic circuit 328 to be transported toward the increased pressure hydraulic fluid output 332. In this manner, the pressure of the charge within the hydraulic circuit 328 is increased by the pumping action of the pumping piston 322. As configured, the check valve 334 prevents the charge from flowing back toward the supply pressure hydraulic fluid input 330. Additionally, though not shown in FIG. 3, an additional check valve may be provided to prevent back flow of hydraulic fluid within the increased pressure hydraulic fluid output 332. Additionally, as shown, the hydraulic circuit 328 may be in fluid communication with an accumulator 340 disposed between the pumping piston bore 324 and the increased pressure hydraulic fluid output 332. In this manner, pressurized hydraulic fluid may be stored in the accumulator 340, thereby maintaining the pressure of the charge in the accumulator (and, consequently, the hydraulic circuit 328) above the supply pressure hydraulic fluid input 330. In turn, the increased pressure hydraulic fluid provided at the output 332 may be used, for example, to improve the time required to refill a lost motion component.

Figure 4:
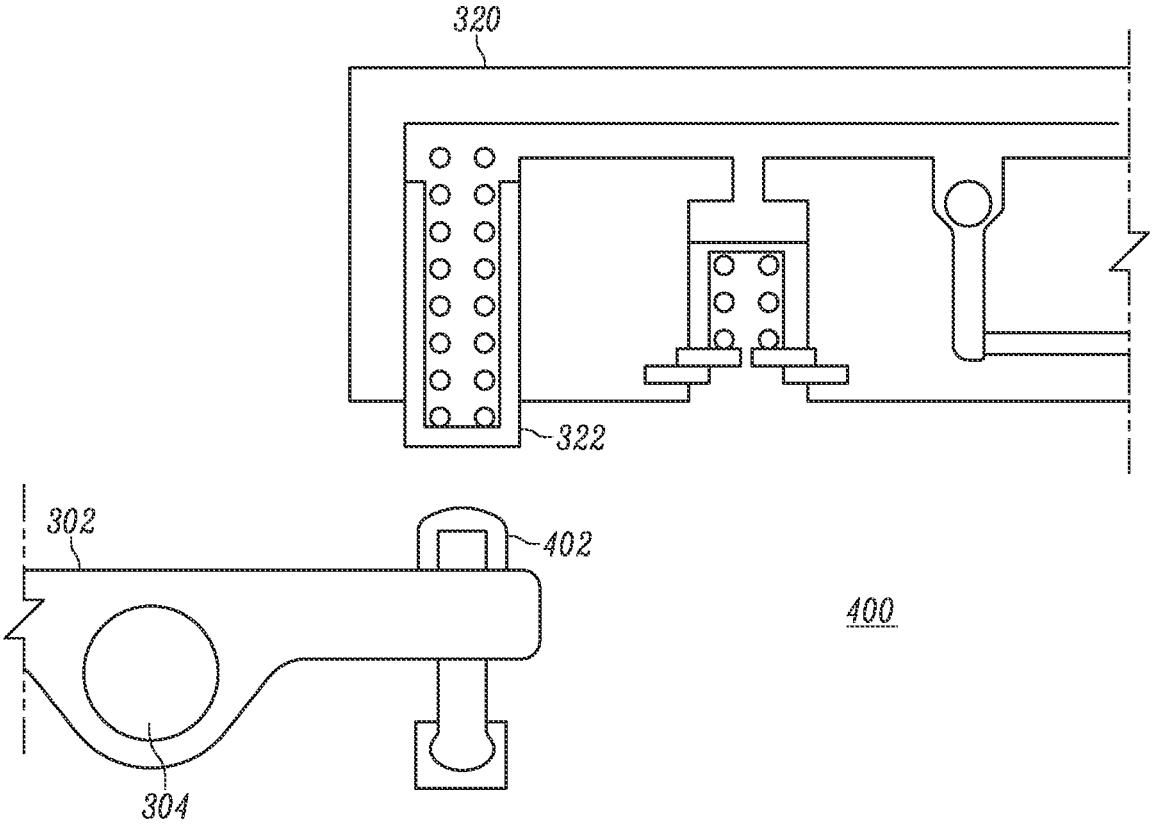

Referring now to FIG. 4, a system 400 similar to the system 300 of FIG. 3 is illustrated. However, in the embodiment of FIG. 4, an adjusting screw assembly 402 is provided on the rocker arm 302 to contact the pumping piston 322. Note that the valve bridge 308 is not illustrated in FIG. 4. It is further noted that some other portion of the rocker arm 302 on its motion imparting side (i.e., to the right of the rocker shaft 304 as shown in FIG. 4), may contact the pumping piston 322. Regardless, the system 400 has the advantage that two valve springs, acting through the valve bridge 308, contribute to the force applied to the pumping piston 322, thereby permitting additional pressure through the pumping action.

Figure 5:
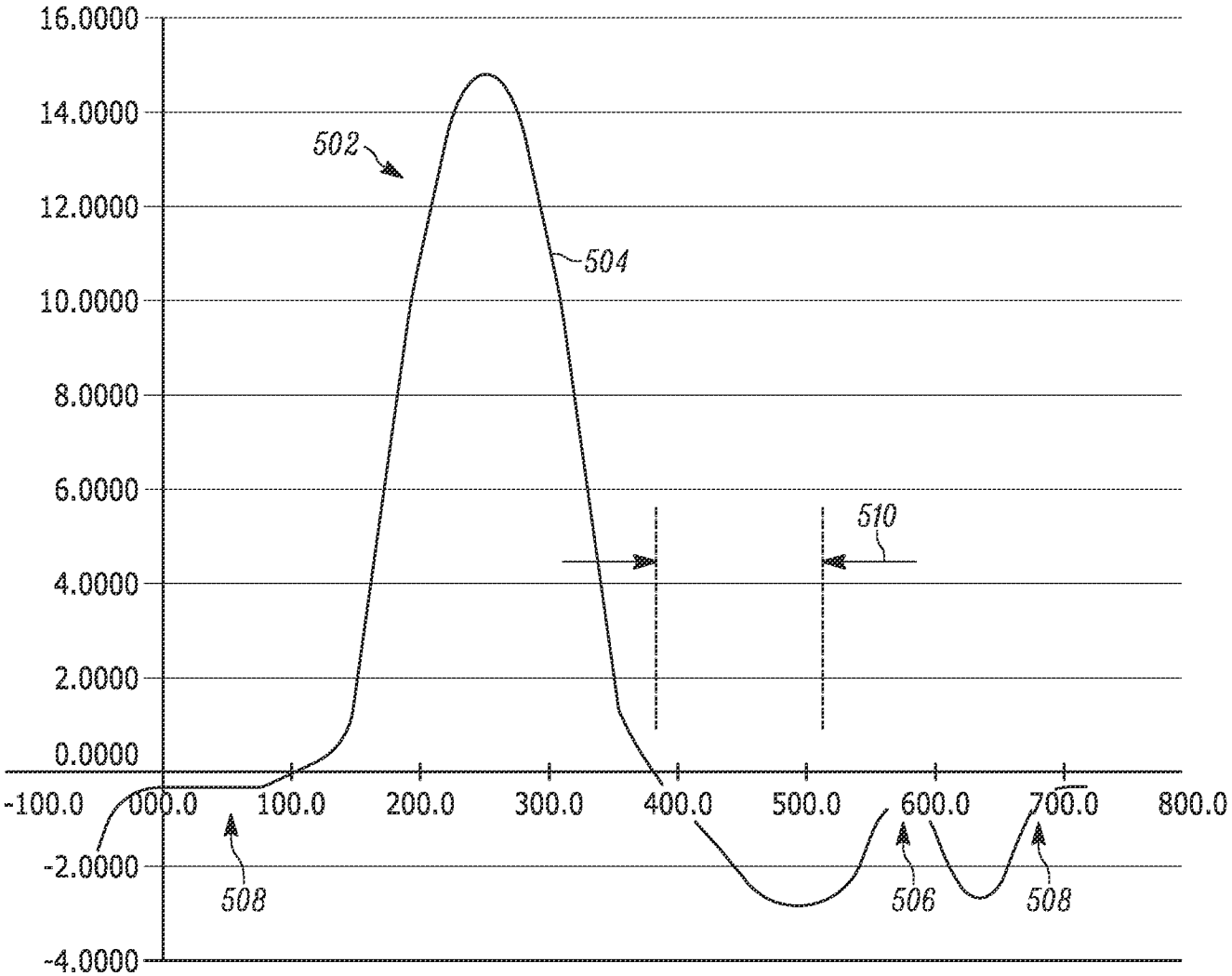
FIG. 5 illustrates a valve lift profile of a typical exhaust valve actuation motion source and a period in which pumping motions in accordance with FIGS. 3 and 4 may be provided.

FIG. 5 illustrates a valve lift profile 502 (as a function of crankshaft angle) of a typical exhaust valve actuation motion source. In particular, the valve lift profile 502 (expressed in millimeters of valve lift) illustrates a so-called exhaust main event 504 and two auxiliary valve events, specifically, a compression-release event 508 and a brake gas recirculation (BGR) event 506. Note that the negative valve lifts illustrated in FIG. 5 illustrate the fact that, as known in the art, the auxiliary valve events 506, 508 may be lost during positive power generation through provision of lash between the valve actuation motion source and the valve train at least as large as the most negative lift value shown. Conversely, when it is desired to incorporate the auxiliary valve events 506, 508 into the operation of the exhaust valve, the lash may be taken up thereby imparting the auxiliary valve events 506, 508 to the valve train. Regardless, FIG. 5 also illustrates a period of time 510, corresponding to a portion of the time that the engine valve would be closing, during which the pumping piston 322 of FIGS. 3 and 4 could be contacted to induce pumping action.

Figure 6:
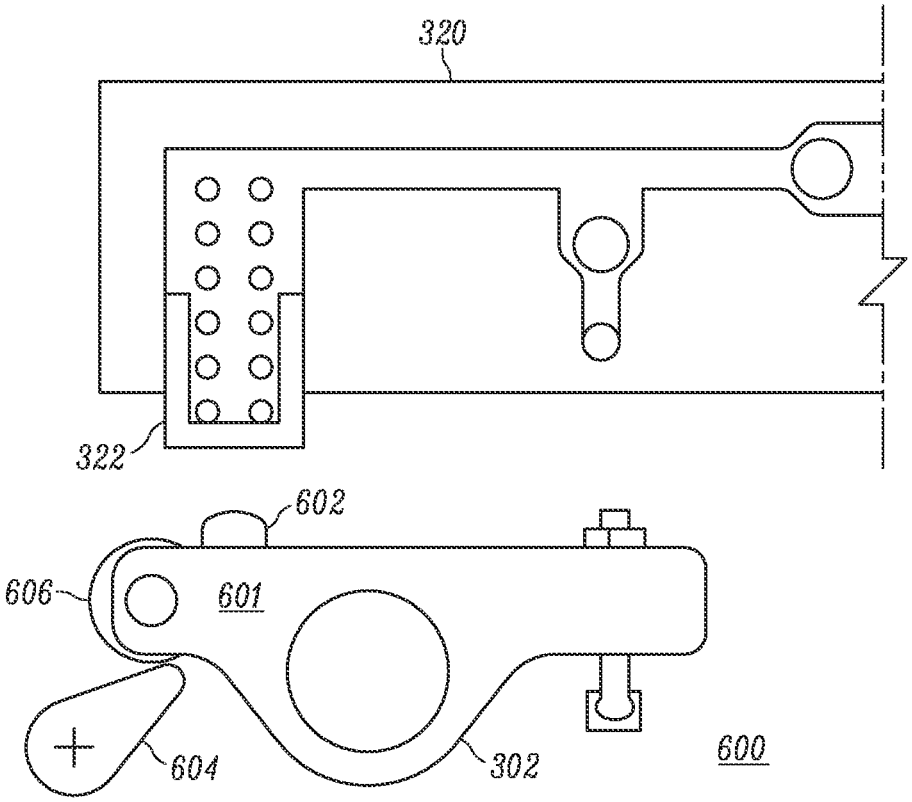
FIG. 6 illustrates an embodiment in accordance with the instant disclosure comprising a pumping assembly disposed within a fixed overhead in which pumping motions are provided during valve opening.

Referring now to FIG. 6, a system 600 similar to the systems 300, 400 of FIGS. 3 and 4 is illustrated. However, in the embodiment of FIG. 6, the housing 320 is configured such that the pumping piston 322 is disposed above a portion of a motion receiving end 601 of the rocker arm 302. Further, a contact surface 602 (illustrated in the form of a protuberance) is provided on the rocker arm 302 in alignment with the pumping piston 322. Once again, the valve bridge 308 is not illustrated in FIG. 6 and, further, that some other portion of the rocker arm 302 on its motion receiving end 601 may contact the pumping piston 322. Note that FIG. 4 illustrates a valve actuation motion source in the form of a rotating cam 604 contacting a further valve train component in the form of a cam roller 606. A feature of the embodiment of FIG. 6 is that the timing of the pressure impulse provided by the pumping piston 322 is shifted to a time during the valve opening stroke of the rocker arm 302 instead of the closing portion. This has an advantage that the valve springs 310 will not be loaded by the pumping pressure, and comparatively higher pressures can be achieved.

Figure 7:
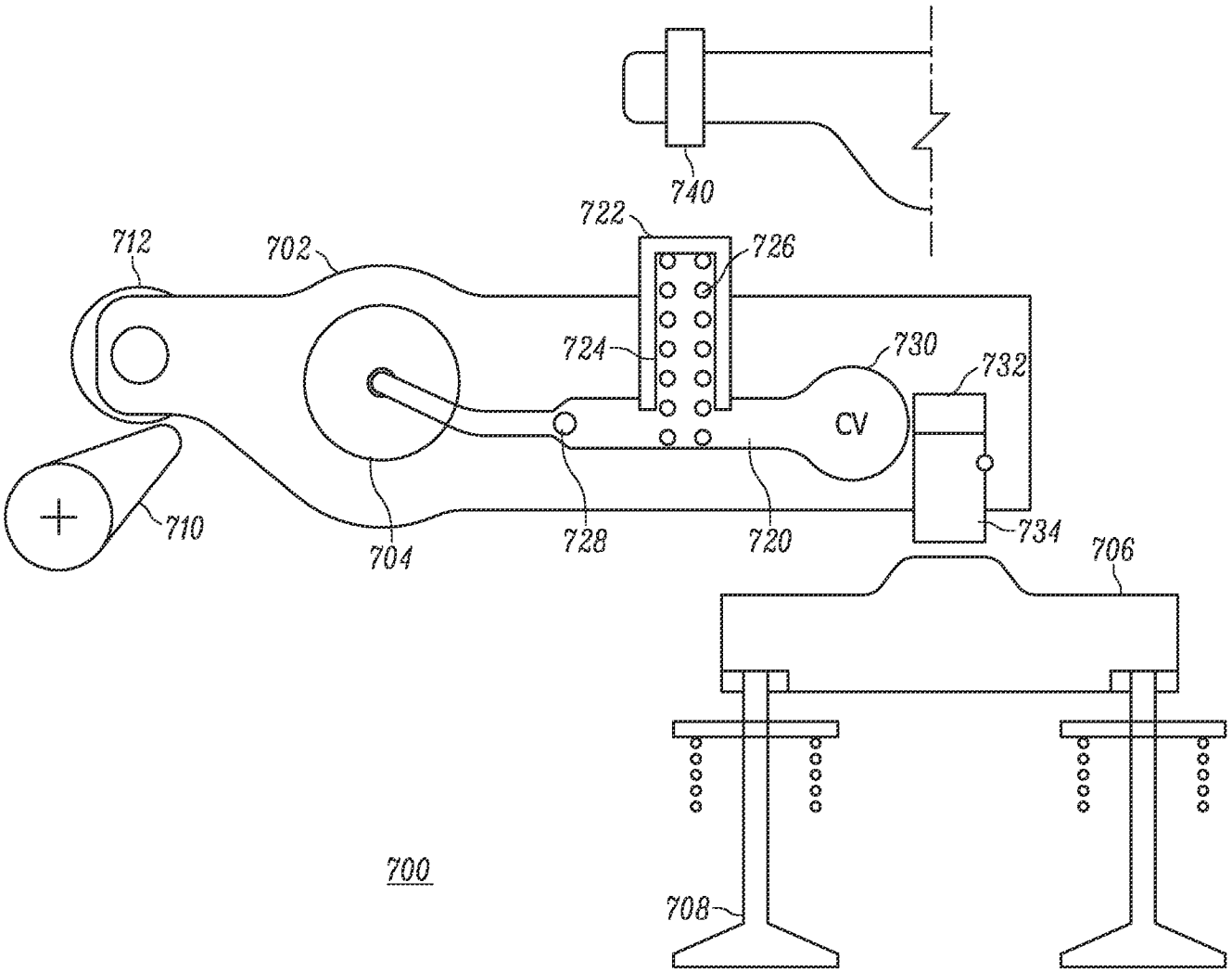
FIG. 7 illustrates an embodiment in accordance with the instant disclosure comprising a pumping assembly disposed within a rocker arm in which pumping motions are provided during valve closing.

FIG. 7 shows an alternative embodiment of a system 700 in which the pumping assembly is disposed within a dynamic housing, i.e., a rocker arm 702 that, in turn, is mounted on a rocker shaft 704. The rocker arm 702 is configured to contact a valve bridge 706 that is itself operatively connected to engine valve 708. Once again, FIG. 7 illustrates a valve actuation motion source in the form of a rotating cam 710 contacting a further valve train component in the form of a cam roller 712 mounted on the rocker arm 702.

As shown, the rocker arm 702 includes a hydraulic circuit 720 in fluid communication with a source of supply pressure hydraulic fluid included in the rocker shaft 704, as known in the art. As in previous embodiments, a pumping piston 722 is disposed within a pumping piston bore 724 that is in fluid communication with the hydraulic circuit 720. Additionally, a resilient element 726 is provided to bias the pumping piston 722 out of the pumping piston bore 724. As valve actuation motions are conveyed to the engine valves 708, closing of the engine valves causes the rocker arm 702 to rotate such that the pumping piston 722 makes contact with a fixed contact surface 740, thereby inducing pumping motions in the pumping piston.

In this embodiment, the hydraulic circuit 720 further communicates with a control valve 730 that (as known in the art) selectively permits the flow of pressurized hydraulic fluid from the increased pressure hydraulic fluid output into an actuator bore 732 and checks the admitted fluid in the actuator bore 732. An actuator piston 734 is disposed within the actuator piston bore 732 such charging and hydraulic locking of the actuator piston bore 732 with the hydraulic fluid causes the actuator piston 734 to contact the valve bridge 706, thereby permitting valve actuation motions provided by the valve actuation motion source 710 to be transmitted to the valve bridge 706 and the engine valves 708. As with other embodiments described above, the embodiment of FIG. 7 may be used in so-called rocker brakes that reset (through mechanisms not shown) and require refilling of hydraulic fluid at the end of the main event timing, i.e., valve closing. The increased pressure hydraulic fluid generated in accordance with this embodiment may be stored in an accumulator (not shown) and subsequently used as described above.

Figure 8:
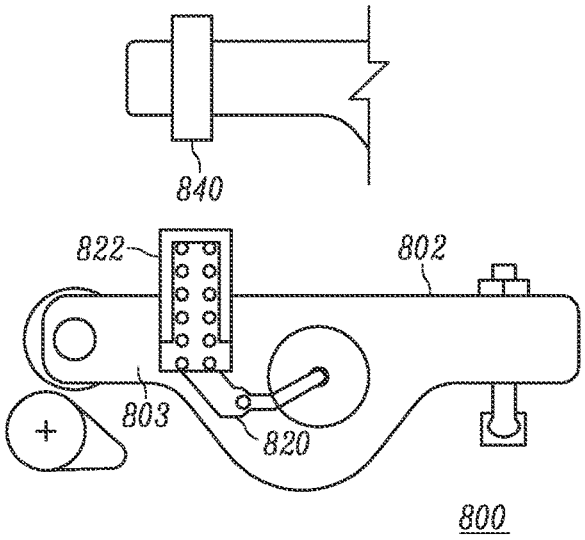
FIGS. 8 and 9 illustrate embodiments in accordance with the instant disclosure comprising a pumping assembly disposed within a rocker arm in which pumping motions are provided during valve opening.

Referring now to FIG. 8, a system 800 similar to the system 700 of FIG. 7 is illustrated in which a hydraulic circuit 820 and pumping piston 822 are disposed within a rocker arm 802. However, in this embodiment, the hydraulic circuit 820 and pumping piston 822 are disposed within a motion receiving end 803 of the rocker arm 802. It is noted that the increased pressure hydraulic fluid output of the hydraulic circuit 820 is not illustrated in FIG. 8. A fixed contact surface 840 in this embodiment is likewise positioned over the motion receiving end 803, specifically aligned with the pumping piston 822. In this case, pumping action occurs when the pumping piston 822 contacts the fixed contact surface 840 during valve opening, e.g., at the onset of a main valve event.

Figure 9:
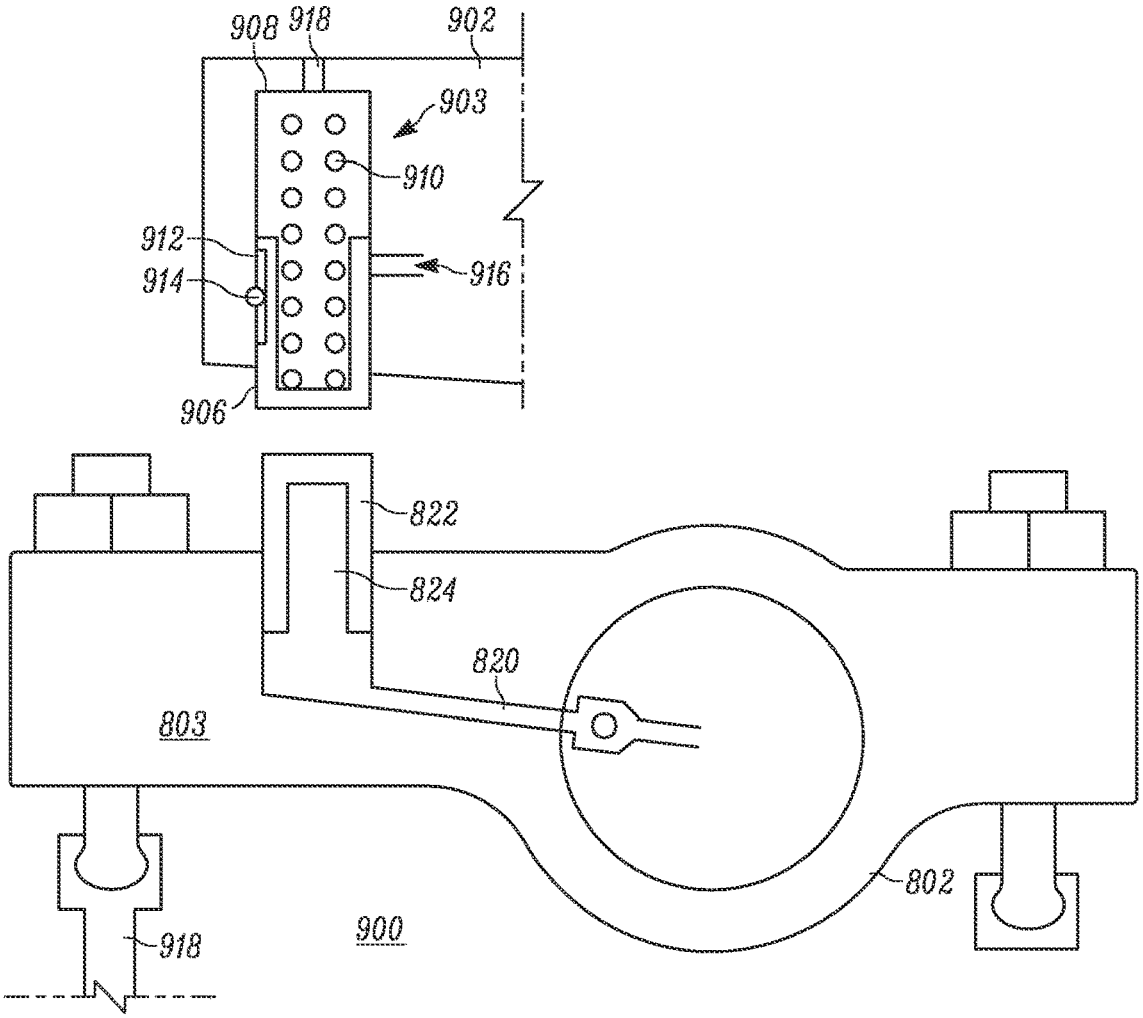

FIG. 9 illustrates a system 900 similar to the system 800 of FIG. 8, particularly in that a rocker arm 802 includes a hydraulic circuit 820, pumping piston 822 and pumping piston bore 824 in a motion receiving end 803 of the rocker arm 802 as described above. Note that, in this embodiment, valve actuation motions are provided by a pushrod 918, as known in the art. Also, in this embodiment, the pumping piston 822 may include a bias spring (not shown) to bias the pumping piston into its bore to prevent undesired motion when the system is off. In this case, as hydraulic fluid supply is selectively turned on via a solenoid valve (not shown), the pumping piston 822 will be extended out of it bore. Conversely, a bias spring (not shown) may bias the pumping piston 822 out of its bore to aid in drawing in hydraulic fluid, and also to control motion when the hydraulic fluid supply is selectively turned off. In this embodiment, the fixed contact surface 840 shown in FIG. 8 is modified to provide a contact-based pressure regulator assembly 903 disposed within a fixed member 902. In this embodiment, the contact-based pressure regulator 903 comprises a regulator piston 906 disposed within a regulator piston bore 908. A resilient element 910 is provided in the piston bore 908, which resilient element 910 may bias the regulator piston 906 out of the regulator piston bore 908. A supply passage 916 may be provided in fluid communication with the regulator piston bore 908 to supply lubrication for the regulator piston 906. A vent hole 918 at the top of the regulator piston bore 908 prevents lubrication fluid from building up above and hydraulically locking the regulator piston 906. As further shown, a lateral groove 912 formed in an exterior surface of the regulator piston 906 may engage a stop 914 thereby limiting travel of the regulator piston 906 both into and out of the regulator piston bore 908.

As the pumping piston 822 contacts the regulator piston 906, the resilient element 910 compresses and applies a force to the pumping piston, thereby pressurizing the hydraulic fluid in the hydraulic circuit 820. Further, because the force applied to the pumping piston 822 is limited by the stiffness of the resilient element 910, the resilient element 910 acts as a pressure regulator to the extent that it prevents excessive pressure generation that might otherwise result if the full force of the valve actuation motion source were permitted to force the pumping piston 822 into contact with an otherwise unmoving fixed contact surface.

Figure 10:
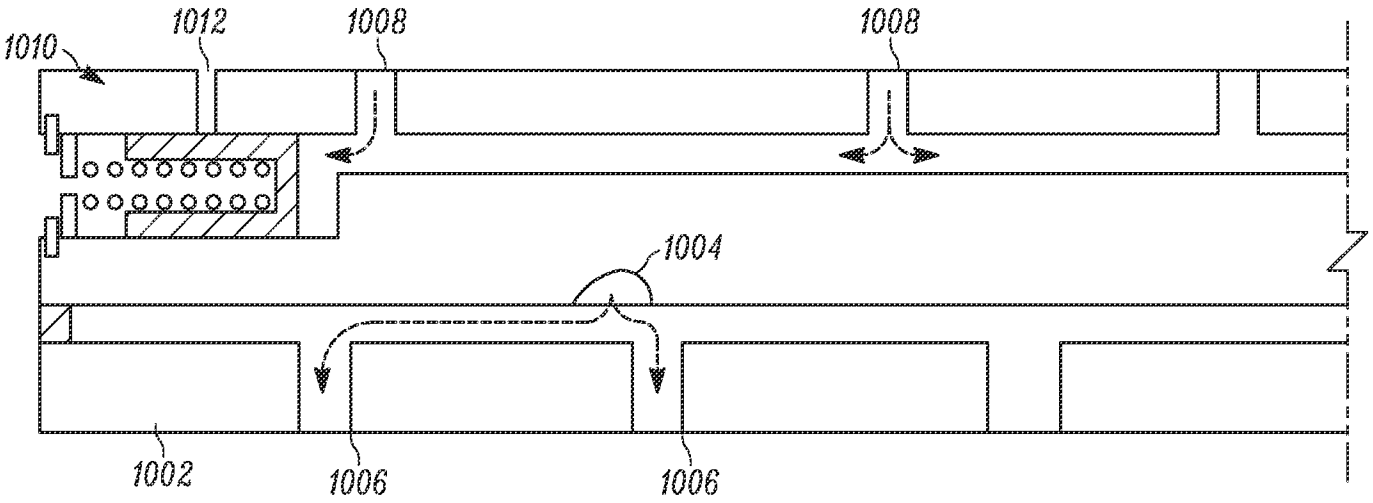
FIG. 10 illustrates an embodiment in accordance with the instant disclosure in which an accumulator is disposed in a rocker shaft, downstream of an increased pressure hydraulic fluid output.

As noted above relative to the various described embodiments, the increased pressure hydraulic fluid may be put to a variety of uses. To facilitate such uses, it may prove desirable to maintain the increased pressure hydraulic fluid at its increased pressure even between pumping cycles. To this end, FIG. 10 illustrates a cross-section of a rocker shaft 1002 in which a hydraulic fluid supply port 1004 supplies hydraulic fluid (illustrated by the light, dashed arrows) to one or more supply passages 1006 that are in fluid communication with the supply pressure hydraulic fluid inputs of respective pumping assemblies that, in this embodiment, reside in corresponding rocker arms (not shown) supported by the rocker shaft 1002. Additionally, one or more return passages 1008 are in fluid communication with the increased pressure hydraulic fluid outputs of the pumping assemblies, as illustrated by the heavy dotted arrows showing the flow of the pressurized hydraulic fluid. Also, an accumulator 1010 is in fluid communication with the return passages 1008, thereby storing and maintained the hydraulic fluid in its pressurized state. Unlike the embodiments of FIGS. 3 and 4 in which an accumulator is placed in fluid communication with and upstream of the increased pressure hydraulic fluid output, it is noted that the accumulator 1010 of FIG. 10 is downstream and in fluid communication with one or more increased pressure hydraulic fluid outputs. In an alternative embodiment, rather than using a single, common, downstream accumulator 1010, each pumping assembly may have its own corresponding downstream accumulator. Regardless, using supply passages not illustrated in FIG. 10, the rocker shaft 1002 may provide the accumulator-stored pressurized hydraulic fluid to multiple sources for engine braking or other uses that require comparatively higher hydraulic fluid pressure. In this embodiment, as known in the art, a pressure relief hole 1012 may be provided in the accumulator bore such that excessive travel of the accumulator piston exposes the hole 1012, which permits pressurized hydraulic fluid to escape and thereby prevent over pressurization.

Figure 11:
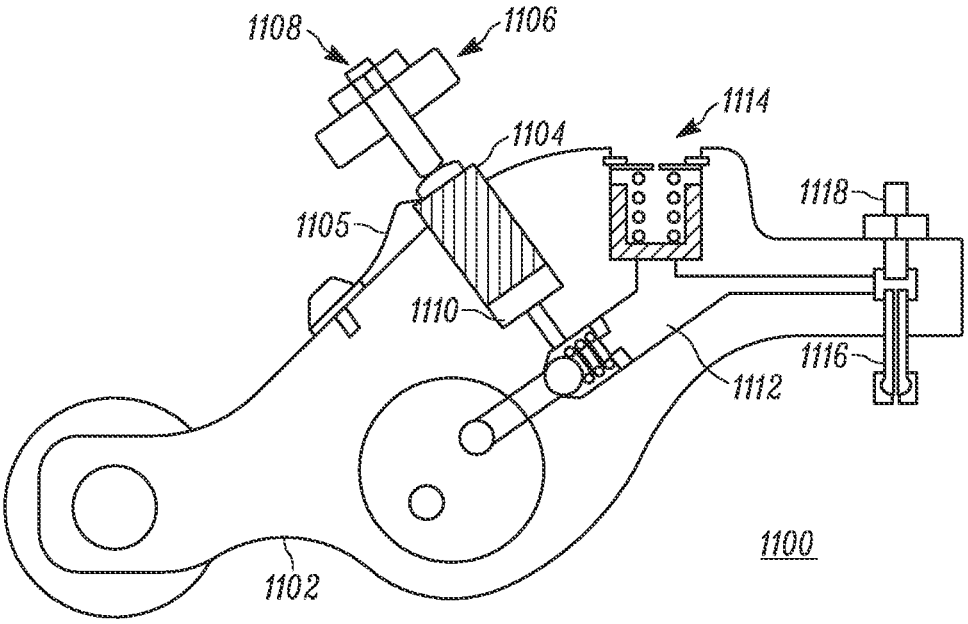
FIG. 11 illustrates an embodiment in accordance with the instant disclosure comprising a pumping assembly disposed within a rocker arm in which pumping motions are provided during valve closing and comprising an accumulator disposed within the rocker arm.

The embodiment illustrated in FIG. 11 may find particular applicability in a pushrod- or overhead cam (OHC)-equipped engine, or a bridge brake application where rapid filling of hydraulic fluid is needed at the end of the main event. In this system 1100, valve springs (not shown) rotate a rocker arm 1102 back toward a valve actuation motion source (also not shown) during the end of a main valve event, i.e., during valve closing, such that a pumping piston 1104 is brought into contact with a fixed contact element 1106 comprising, in this case, and adjustable screw 1108. As in previous embodiments, the pumping piston 1104 is slidably disposed within a pumping piston bore 1110 that is itself in fluid communication with a hydraulic circuit 1112. A resilient element 1105 biases the pumping piston into the pumping piston bore 1110 to prevent undesired piston 1110 motion when the system is inactive and hydraulic fluid supply is selectively deactivated. Further still, the hydraulic circuit 1112 is in fluid communication with an accumulator 1114. In this embodiment, the increased pressure hydraulic fluid output is coupled directly to a supply passage 1116 in an adjusting screw 1118. The supply passage 1116 then supplies the pressurized hydraulic fluid to a so-called bridge brake, facilitating operation thereof.

Figure 12:
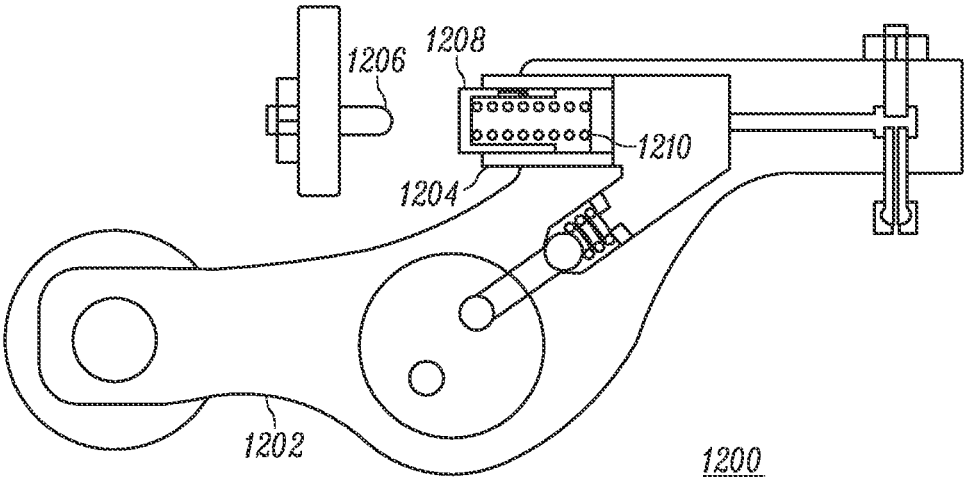
FIGS. 12 and 19 illustrate embodiments in accordance with the instant disclosure comprising a pumping assembly disposed within a rocker arm in which pumping motions are provided during valve closing and comprising a contact-based pressure regulator disposed within a pumping piston.

A system 1200 similar to the system 1100 of FIG. 11 is illustrated in FIG. 12 in that a pumping piston 1204 is disposed in a rocker arm 1202 and configured to contact a fixed contact surface 1206. In this case, however, the system 1200 further comprises a contact-based pressure regulator in the form of spring-loaded piston 1208 disposed within the pumping piston 1204. As in the embodiment of FIG. 9, operation of the spring-loaded piston 1208 is controlled by the relative stiffness of its corresponding spring 1210. As in the embodiment of FIG. 9, when a main event ends (i.e., on valve closing) and the rocker arm 1202 rotates toward the valve actuation motion source (not shown), the spring 1210 compresses and generates hydraulic fluid pressure in the rocker arm 1202, while simultaneously serving to limit the pressurization of the hydraulic fluid.

Figure 13:
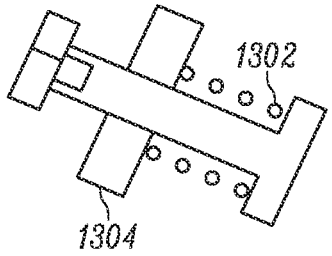
FIGS. 13-15 illustrate alternate embodiments of contact-based pressure regulators external to a pumping piston in accordance with the instant disclosure.
Figure 14:
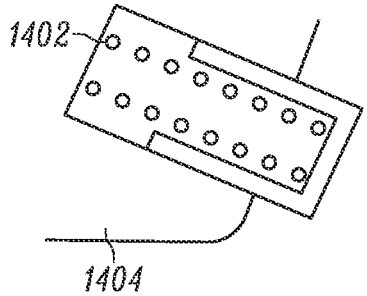
Figure 15:
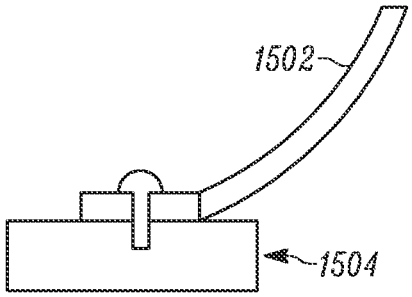

The system 1200, for example, could be used in conjunction with several different contact-based pressure regulator embodiments, various non-limiting examples of which are illustrated in FIGS. 13-15. In each of the illustrated embodiments, a resilient element 1302, 1402, 1502, external to the pumping piston, is secured to a fixed member 1304, 1404, 1504 such that the resilient element 1302, 1402, 1502 can apply a force on a pumping piston while simultaneously limiting such force. Once again, during main valve event closure, the pumping piston will compress the resilient element 1302, 1402, 1502 thereby storing energy to provide a steady oil pressure during a refill period. Force applied in this manner maintains a high oil pressure as provided by a pumping assembly without having to place a separate accumulator in the housing. This may be required in cases where the space is not available to package the accumulator or accumulator spring within the housing itself.

Figure 16:
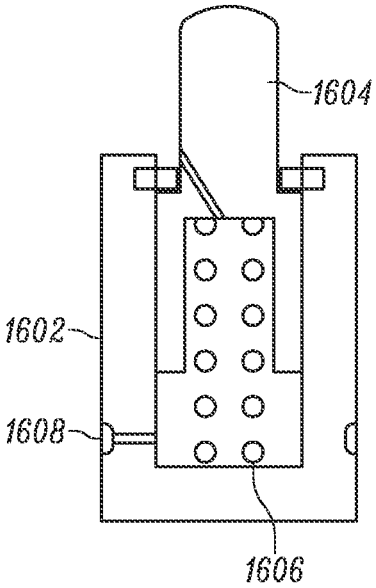
FIGS. 16-18 illustrate alternate embodiments of contact-based pressure regulators internal to a pumping piston in accordance with the instant disclosure.
Figure 17:
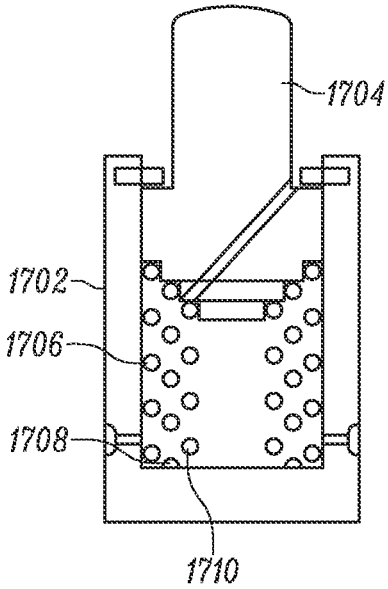
Figure 18:
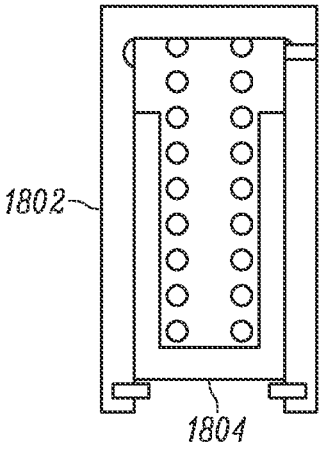

As further illustrated in FIGS. 16-18, a pumping piston 1602, 1702, 1802 may incorporate a spring-loaded piston in a variety of ways. It should be noted that in each of FIGS. 16-18, the hydraulic fluid load is placed on the bottom surface illustrate in each Figure. For example, in FIG. 16, the pumping piston 1602 comprises an inner, secondary piston 1604 driven by contact with a fixed contact surface (not shown). In this embodiment, a spring 1606 fits inside both pistons, as illustrated. As further shown, a small hole 1608 may be provided in the outer piston to supply lubricant to its interior in order to prevent seizing. A variation of the embodiment of FIG. 16 is illustrated in FIG. 17, in which the inner, secondary piston 1704 has a shorter length along its longitudinal axis. Additionally, a wider spring 1706, along with additional concentric springs 1708, 1710 to provide additional spring force in a similarly sized package, are shown. In the embodiment of FIG. 18, hydraulic fluid pressure is applied to the bottom of inner piston 1804 instead of the pumping piston 1802.

Figure 19:
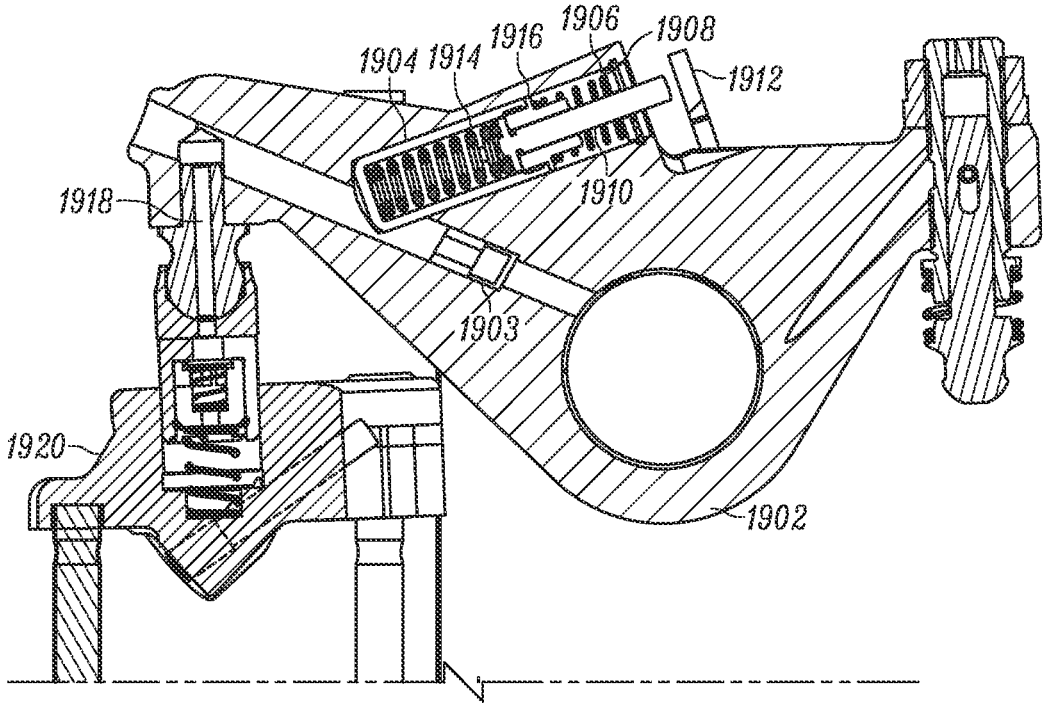

Another example of a spring loaded pumping piston, incorporated into an exhaust rocker arm 1902, is further illustrated in FIG. 19. During main event opening, supply pressure hydraulic fluid (flowing past the optional check valve 1903) pushes up against the pumping piston 1904, which piston moves upwards, possibly against a light bias provided by an optional spring 1906. The assembly comprising the pumping piston 1904 continues to move upward until it contacts a snap ring 1908. During main event closing, the rocker arm 1902 moves back and an inner piston 1910 makes contact with a fixed contact surface 1912, thereby causing the inner piston 1910 to push against spring 1914 creating stored spring energy and raising the hydraulic fluid pressure. As shown, the inner piston 1910 is guided by a threaded collar/bushing 1916. Hydraulic fluid below the pumping piston 1904 is checked and will therefore be increasingly pressurize with the rise in the force applied by the spring 1914. During refilling, the pressurized oil flows out the head of the rocker arm 1902 through a passageway 1918 in an adjusting screw (sometimes referred to as an elephant foot) that, in turn, is in fluid communication with, in this example, a valve bridge 1920. As the rocker rotates back, the inner piston 1910 is pushed further into the rocker arm 1902. At the same time, the pumping piston 1904 moves downward as the hydraulic fluid moves out and the spring 1914 expands as the hydraulic fluid is lost, thereby maintaining the pressure.

Figure 20:
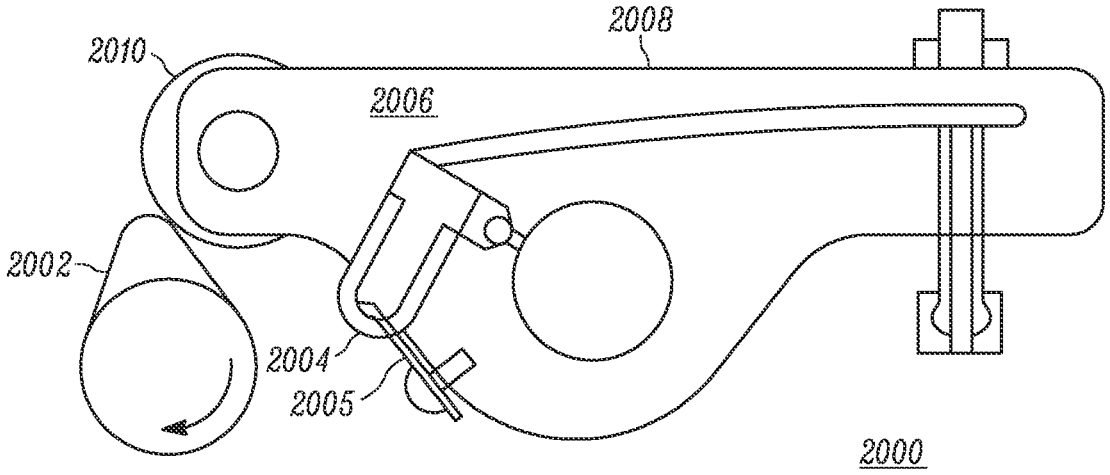
FIG. 20 illustrates an embodiment in accordance with the instant disclosure comprising a pumping assembly disposed within a rocker arm in which pumping motions are provided after valve closing and through contact between a pumping piston and a valve actuation motion source.
Figure 21:
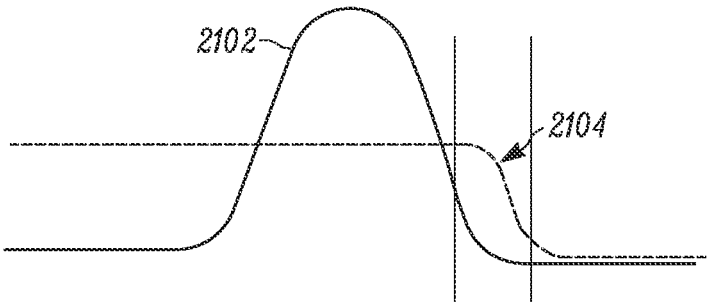
FIG. 21 illustrates a valve lift profile of a typical exhaust valve actuation motion source and a period in which pumping motions in accordance with FIG. 20 may be provided.

FIG. 20 illustrates a system 2000 in which a cam lobe 2002 makes contact with a pumping piston 2004 disposed in a motion receiving end 2006 of the rocker arm 2008 after the main event begins to close. Note that, in this embodiment, the pumping piston 2004 is biased inward by a suitable resilient element 2005. Regardless, as the clockwise rotation (as illustrated in FIG. 20) of the cam lobe 2002 completes the provision of valve actuation motions to the rocker arm 2008 via a cam roller 2010, the cam continues into contact with the pumping piston 2004. Contact occurs during the closing of the main event when (in the case of a valve bridge having a hydraulic lost motion component) the supply of hydraulic fluid is needed, and when the relative velocity between the cam lobe 2002 and the pumping piston 2004 are low. FIG. 21 illustrates the timing of a typical main event 2102 provided by the cam lobe 2002 relative to the motion 2104 of the pumping piston 2004. By adjusting the location of the pumping piston 2004 relative to the cam lobe 2002, the timing of the pumping event (i.e., the inward pushing of the pumping piston 2004) can be likewise adjusted. Preferably, the orientation of the pumping piston 2004 may be select such that the loading is inwards towards the rocker shaft, and the torque created by the pumping load can be minimized.

Figure 22:
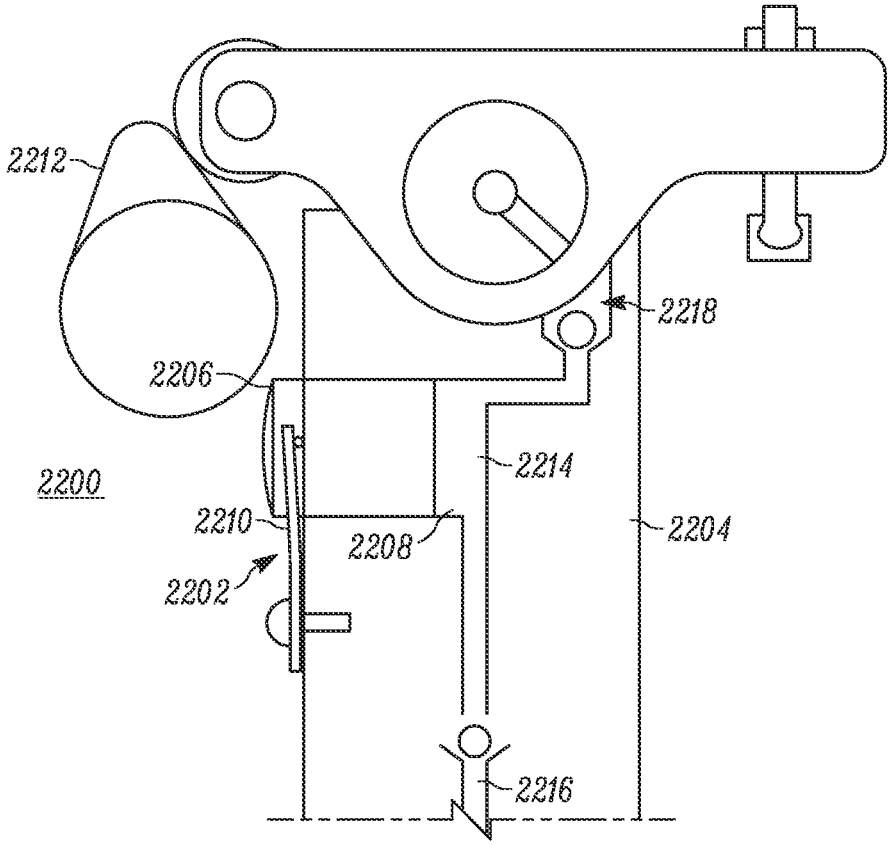
FIGS. 22 and 23 illustrate embodiments in accordance with the instant disclosure comprising a pumping assembly disposed within a fixed engine support structure in which pumping motions are provided after valve closing and through contact between a pumping piston and a valve actuation motion source or a dedicated pumping motion source.

Referring now to FIG. 22, a system 2200 is illustrated in which a pumping assembly 2202 is located in a fixed housing 2204, such as on the cylinder head, or potentially in the engine block (for cam in block engines). The pumping piston 2206 (which may comprise a piston that is a flat follower, radius or spherical follower, or a roller follower design) would normally be maintained in a retracted position within its pumping piston bore 2208 (in order to avoid spurious contact with a cam lobe 2212) and, in the illustrated example, a flat spring 2210 is used to maintain the pumping piston 2206 in the retracted position. During normal operation, the piston is retracted away from the cam lobe and no hydraulic fluid is pumped. When higher pressure is demanded by the system 2200, supply pressure hydraulic fluid is introduced to the hydraulic circuit 2214 and pumping piston bore 2208, thereby causing the pumping piston 2206 to overcome the bias of the flat spring 2210 and extend in the direction of the cam lobe 2212. When the cam lobe 2212 contacts the pumping piston 2206, hydraulic fluid is pumped into the fixed housing 2204 for use in its desired purpose. As shown, check valves 2216, 2218 (of varying types) may be used to prevent backflow of the pressurized hydraulic fluid. Once again, as in the embodiment of FIG. 20, the pumping piston 2206 position and angle may be adjusted to set the timing of the pump delivery to correspond with a demand event from the hydraulic system 2200. Additionally, as described above, there may be one or more accumulators downstream from the pumping assembly designed to store oil pressure, or the pumping piston 2206 may include such devices as illustrated in FIGS. 16-18.

Figure 23:
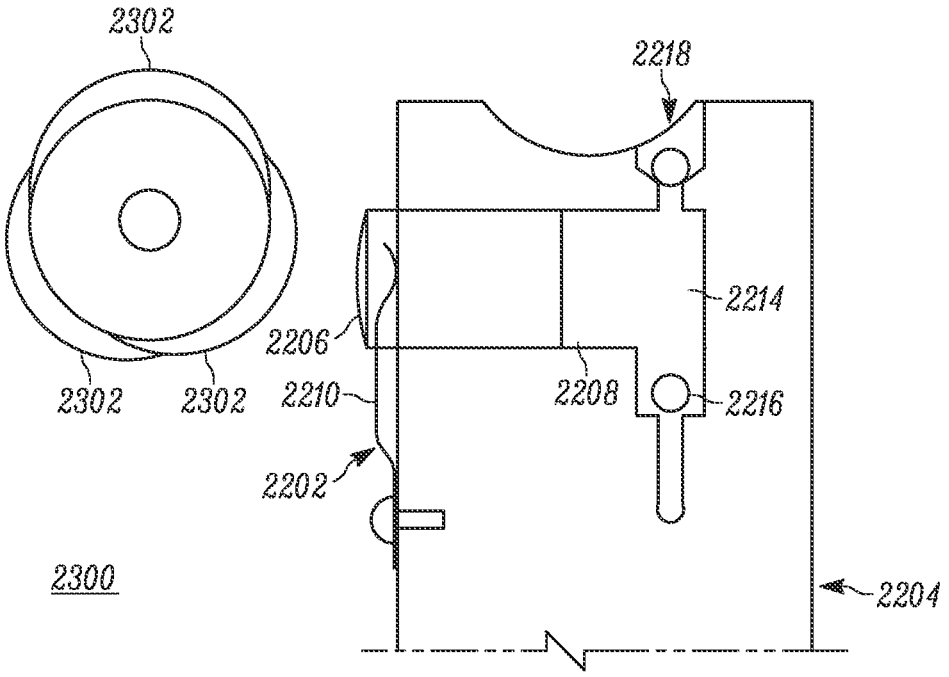

The embodiment of FIG. 23 illustrates a system 2300 substantially similar to the system 2200 of FIG. 22. However, in this instance, the system 2300 comprises a cam having cam lobes 2302 specifically designed for and dedicated to pumping hydraulic fluid. The number of lobes 2302, and the timing of the pumping events can be adjusted to suit the system's demand for hydraulic fluid pressure. This can aid filling the circuits when demand for pressurized hydraulic fluid is high, and can also minimize pulsation in the system 2300. The location of the pumping piston 2206 and its angle relative to the cam lobes 2302 can again be used to adjust timing as well as the stroke of the pumping piston 2206.

Figure 24:
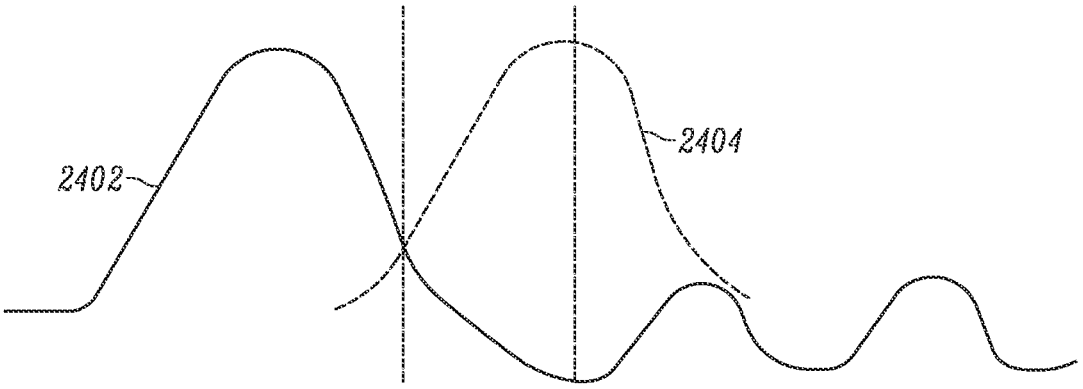
FIG. 24 illustrates valve lift profiles of typical exhaust and intake valve actuation motion sources.
Figure 25:
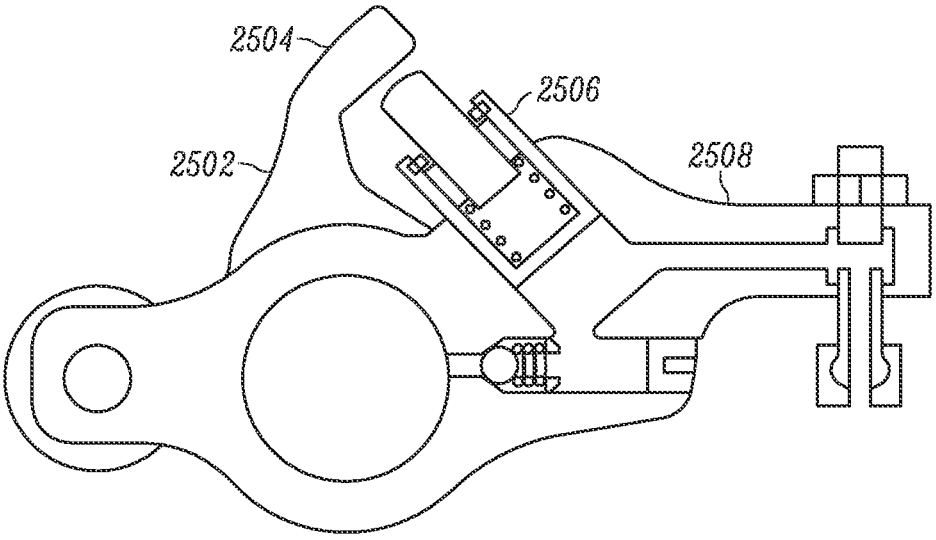
FIG. 25 illustrates an embodiment in accordance with the instant disclosure comprising a pumping assembly disposed within an exhaust rocker arm in which pumping motions are provided after valve closing and through contact between a pumping piston and an intake rocker arm.

Referring now to FIG. 24, comparison of a typical exhaust lift profile 2402 and typical intake lift profile 2404 reveals that the motions resulting from the intake lift profile 2404 align with times (i.e., subsequent to exhaust main event valve closing) when it may be desirable to inducing pumping of hydraulic fluid. This suggests that, in yet another embodiment, the motions derived from an intake rocker arm may act as a source of pumping motions during a desired exhaust valve refill time. An example of such an arrangement is illustrated in FIG. 25 in which the valve actuation motions from an intake valve actuation motion source drive an intake rocker arm 2502. In this case, a cantilevered member 2504 extending from the intake rocker arm 2502 "reaches over" to a pumping piston 2506 disposed with an exhaust rocker arm 2508. Note that the pumping piston 2506, as shown, has a construction substantially similar to the embodiment illustrated in FIG. 16 described above. Regardless, intake valve actuation motions provided by the member 2504 can be used to directly drive the pumping piston 2506.

Figure 26:
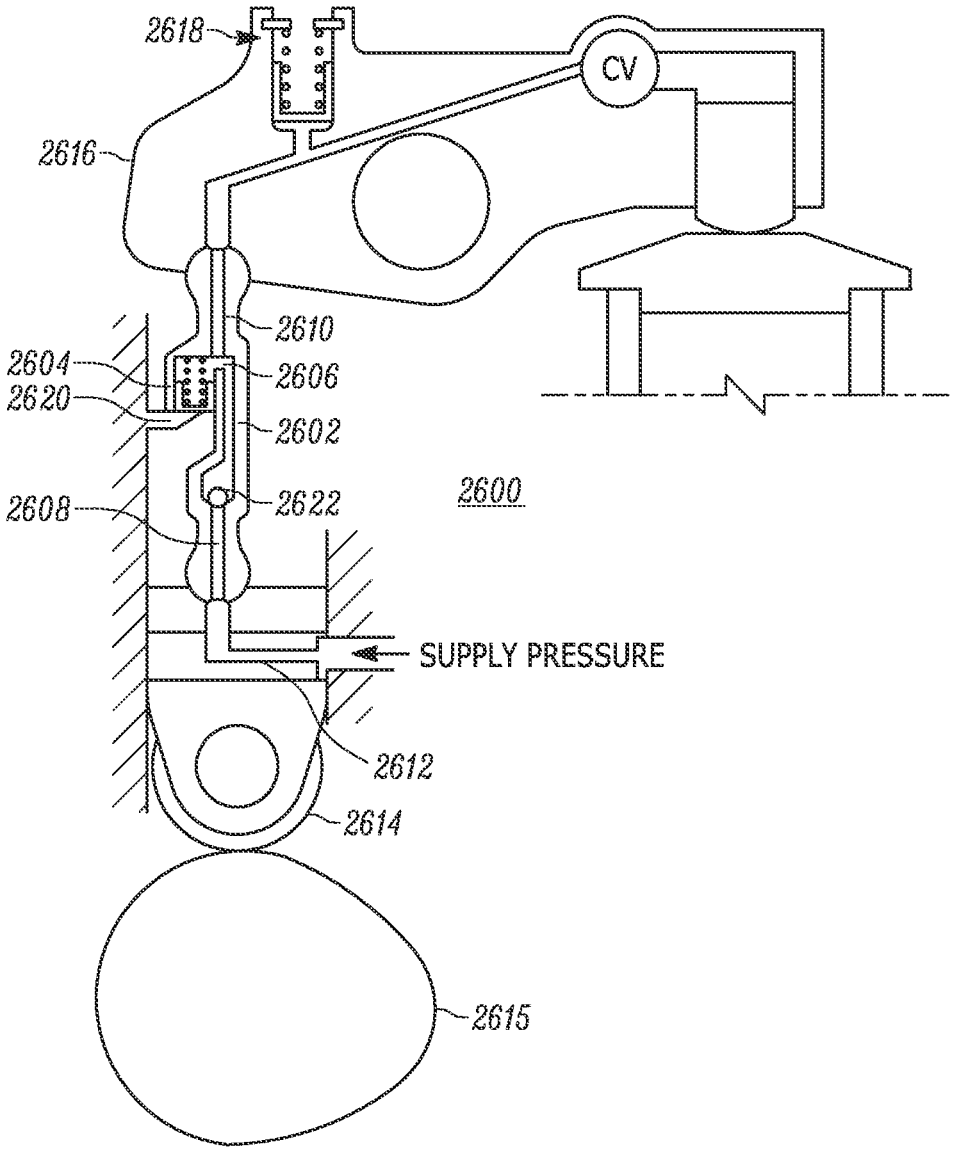
FIG. 26 illustrates an embodiment in accordance with the instant disclosure comprising a pumping assembly disposed within a pushrod in which pumping motions are provided during valve closing.

Referring now to FIG. 26, a system 2600 is illustrated in which the dynamic housing used to maintain the pumping assembly is a valve train component other than a rocker arm, namely a pushrod 2602. In particular, the pushrod 2602 includes a pumping piston 2604 and a hydraulic circuit 2606 as shown. A supply pressure hydraulic fluid input 2608 and an increased pressure hydraulic fluid output 2610 are in fluid communication with the hydraulic circuit 2606 as shown. The supply pressure hydraulic fluid input 2608 receives hydraulic fluid from a supply passage 2612 formed in a cam follower 2614 that is in contact with a cam 2615. Similarly, the increased pressure hydraulic fluid output 2610 may be in fluid communication with a supply passage formed, in this example, in a rocker arm 2616. As further shown, the rocker arm 2616 may include a downstream accumulator 2618 as described above.

As rotation of the cam 2615 induces reciprocal motion in the cam follower 2614 and the pushrod 2602, the pumping piston 2604 is brought into contact with a fixed contact surface 2620 that, in the illustrate example, comprises a cantilevered projection. The resulting pumping action pressurizes hydraulic fluid in the hydraulic fluid circuit 2606. In keeping with various ones of the above-described embodiments, a check valve 2622 may be provided to prevent the backflow of pressurized hydraulic fluid.

Figure 27:
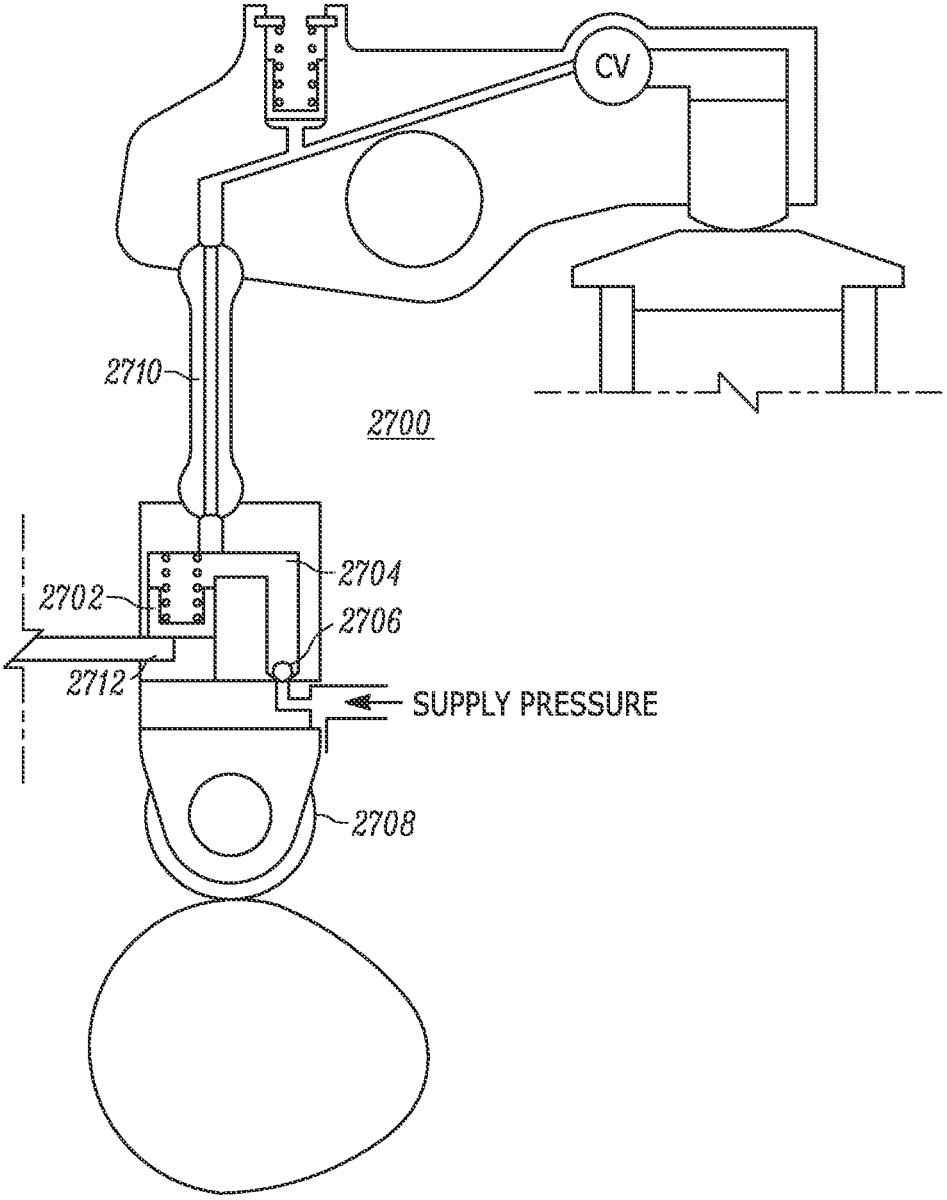
FIG. 27 illustrates an embodiment in accordance with the instant disclosure comprising a pumping assembly disposed within a cam follower in which pumping motions are provided during valve closing.

FIG. 27 illustrates a system 2700 similar to the system 2600 illustrated in FIG. 26, with the exception that the pumping piston 2702, hydraulic circuit 2704 and check valve 2706 are disposed within the cam follower 2708 rather than the pushrod 2710. Consequently, the fixed contact surface 2712 is reconfigured to extend into contact with the pumping piston 2702 within its location in the cam follower 2708.

Figure 28:
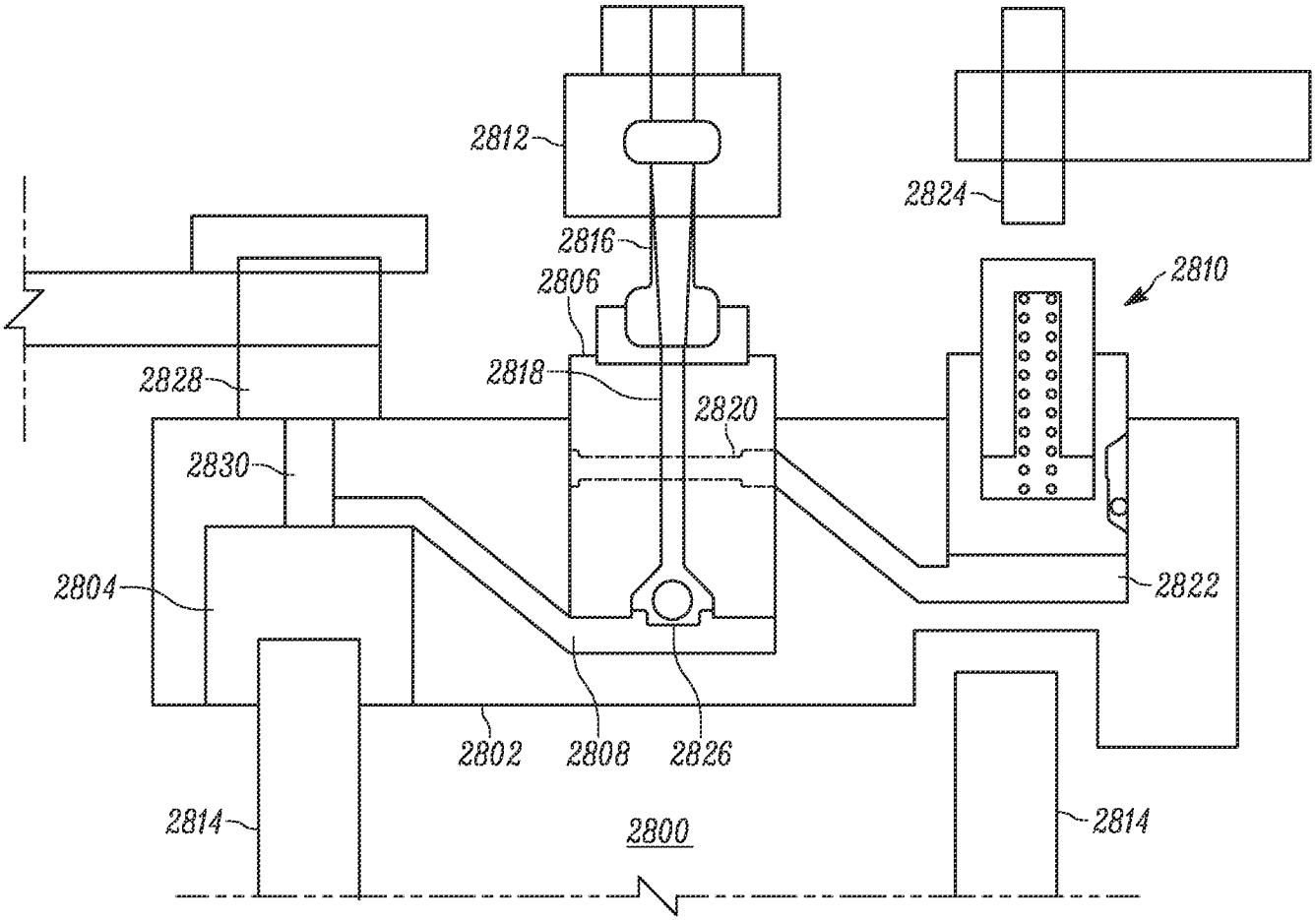
FIG. 28 illustrates an embodiment in accordance with the instant disclosure comprising a pumping assembly disposed within a valve bridge in which pumping motions are provided during valve closing.

Finally, FIG. 28 illustrates a system 2800 in which the pumping assembly is disposed within yet another valve train component, specifically a valve bridge 2802 configured as a so-called master/slave single valve bridge brake. In particular, as known in the art, a slave piston 2804 is in fluid communication with a master piston 2806 via a hydraulic circuit 2808. In this embodiment, a pumping assembly 2810 (e.g., of the type illustrated and described above relative to FIGS. 16-18) is also provided in the valve bridge 2802. Fluid supplied from a rocker arm 2812 (partially shown) is selectively actuated to fill the lost motion bridge when it desired to apply otherwise lost motion to the engine valve 2814. When activated, supply pressure hydraulic fluid flows into the valve bridge 2802 through the rocker arm's adjusting screw 2816, a passageway 2818 in the master piston 2806 and into the hydraulic circuit 2808, thereby extending the master piston 2806 out of its bore. An annulus 2820 formed in the master piston bore around the master piston 2806 receives hydraulic fluid from the passageway 2818 that then flows into a pumping piston bore 2822, thereby extending the pumping assembly during a main event lift. During closing of the valves 2814, the pumping piston 2810 makes contact with a fixed contact surface 2824 and pressurizes the supply pressure hydraulic fluid as described above. The resulting increased pressure hydraulic fluid then flows back through the annulus 2820 and passageway 2818 to increase pressure within the hydraulic circuit 2808 during the refill period (i.e., after valve closing) thereby aiding with extension of the master piston 2806 and filling the valve bridge 2802. An optional check valve in the rocker arm (not shown) can prevent backflow of hydraulic fluid and improve the pumping efficiency. During braking, motion of the rocker arm 2812 causes the master piston 2806 to move downward while a check valve 2826 in the master piston 2806 prevents backflow of oil and hydraulically locks the circuit 2808 between the master piston 2806 and the slave piston 2804. Pressure above the slave piston 2804 causes the valve bridge body to contact another reaction surface 2828 above, and causes the slave piston 2804 to push downward and open a single exhaust valve 2814. After the braking lift (event), increased lift of a main event causes the master piston 2806 to bottom out in its bore and move the valve bridge body downward away from the reaction post 2828. Consequently, a bleed hole 2830 in the slave piston bore is exposed and causes a venting of the hydraulic fluid in the hydraulic circuit 2808, and resetting of the lost motion circuit.

While particular preferred embodiments have been shown and described, those skilled in the art will appreciate that changes and modifications may be made without departing from the instant teachings. For example, in keeping with the embodiment of FIG. 25, various ones of the pumping assemblies described above may be located in the intake side of the engine given that the timing of hydraulic fluid pumping may match better on intake valve events. It is therefore contemplated that any and all modifications, variations or equivalents of the above-described teachings fall within the scope of the basic underlying principles disclosed above.

What is claimed is:

1. A system for supplying hydraulic fluid in an internal combustion engine comprising at least one engine valve operatively connected to a valve actuation motion source via a valve train, the system comprising:

a pumping assembly disposed within a housing, wherein the housing is a rocker arm or a valve bridge, the pumping assembly comprising a pumping piston bore formed in and integral to the housing and a pumping piston disposed in the pumping piston bore;

a hydraulic circuit disposed within the housing, in fluid communication with the pumping piston bore, and comprising a supply pressure hydraulic fluid input and an increased pressure hydraulic fluid output, wherein the increased pressure hydraulic fluid output does not directly convey valve actuation motions to the at least one engine valve;

a one-way valve disposed within the hydraulic circuit between the supply pressure hydraulic fluid input and the pumping assembly, and configured to prevent fluid flow from the hydraulic circuit toward the supply pressure hydraulic fluid input; and a source of pumping motions operatively connected to the pumping assembly, wherein the pumping motions applied to the pumping assembly cause the pumping assembly to transmit hydraulic fluid received via the supply pressure hydraulic fluid input to the increased pressure hydraulic fluid output.

2. The system of claim 1, the pumping assembly further comprising:

a resilient element configured to bias the pumping piston out of the pumping piston bore.

3. The system of claim 1, the pumping assembly further comprising:

a resilient element configured to bias the pumping piston into the pumping piston bore.

4. The system of claim 1, the pumping assembly further comprising:

a contact-based pressure regulator operatively connected to the pumping piston.

5. The system of claim 4, wherein the contact-based pressure regulator comprises a spring-loaded piston disposed within the pumping piston.

6. The system of claim 4, wherein the contact-based pressure regulator comprises a resilient element biasing the pumping piston into the pumping piston bore.

7. The system of claim 1, the pumping assembly further comprising:

an accumulator in fluid communication with the hydraulic circuit between the pumping piston bore and the increased pressure hydraulic fluid output.

8. The system of claim 1, further comprising:

an accumulator in downstream fluid communication with the increased pressure hydraulic fluid output.

9. The system of claim 1, wherein the source of the pumping motions contacts the pumping assembly.

10. The system of claim 1, further comprising:

a fixed contact surface, wherein the source of the pumping motions contacts the housing such that the pumping motions cause the pumping assembly to contact the fixed contact surface.

11. The system of claim 1, wherein the valve actuation motion source comprises a cam.

12. The system of claim 1, wherein the source of the pumping motions comprises another rocker arm.

13. The system of claim 1, further comprising:

a contact-based pressure regulator external to the pumping assembly, wherein the source of the pumping motions contacts the housing such that the pumping motions cause the assembly to contact the contact-based pressure regulator.

* * * * *